United States Patent [19]

Gerster

[11] Patent Number: 4,591,472

[45] Date of Patent: May 27, 1986

[54] PROCESS FOR THE PREPARATION OF BLANKS

[75] Inventor: Thomas Gerster, Laufen, Switzerland

[73] Assignee: Keramik Holding AG Laufen, Laufen, Switzerland

[21] Appl. No.: 473,206

[22] Filed: Mar. 8, 1983

[30] Foreign Application Priority Data

Mar. 17, 1982 [CH] Switzerland ..... 1672/82

[51] Int. Cl.[4] ..... B28B 1/26

[52] U.S. Cl. ..... 264/87; 264/101; 264/571

[58] Field of Search ..... 264/86, 87, 101, 571

[56] References Cited

U.S. PATENT DOCUMENTS

| | | | |
|---|---|---|---|
| 1,340,308 | 5/1920 | Williams | 264/87 |
| 1,692,887 | 11/1928 | Casselman | 264/87 |
| 3,225,414 | 12/1965 | Dean | 264/87 |
| 3,536,799 | 10/1970 | Spy | 264/86 |
| 3,634,559 | 1/1972 | Haes | 264/86 |
| 3,663,681 | 5/1972 | Ehrlich | 264/86 |
| 3,958,908 | 5/1976 | Schubart | 264/86 |
| 4,320,080 | 3/1982 | Esper | 264/86 |
| 4,413,966 | 11/1983 | Mills et al. | 264/86 |

FOREIGN PATENT DOCUMENTS

| | | |
|---|---|---|
| 3319012 | 5/1982 | Fed. Rep. of Germany . |
| 2124540 | 2/1984 | United Kingdom . |

*Primary Examiner*—Donald Czaja
*Assistant Examiner*—Mary Lynn Fertig
*Attorney, Agent, or Firm*—Ladas & Parry

[57] ABSTRACT

The invention relates to a process for the mass-production conversion of an inorganic and/or organic material, containing a liquid fraction of between 3 and 90% by weight, to a blank by means of core casting and/or hollow casing, the material being introduced into a cavity located between at least two porous mould portions and being dewatered in contact with the adjacent mould portions.

10 Claims, 9 Drawing Figures

PROCESS FOR THE PREPARATION OF BLANKS

PROCESS FOR THE PREPARATION OF BLANKS

Figure 1:
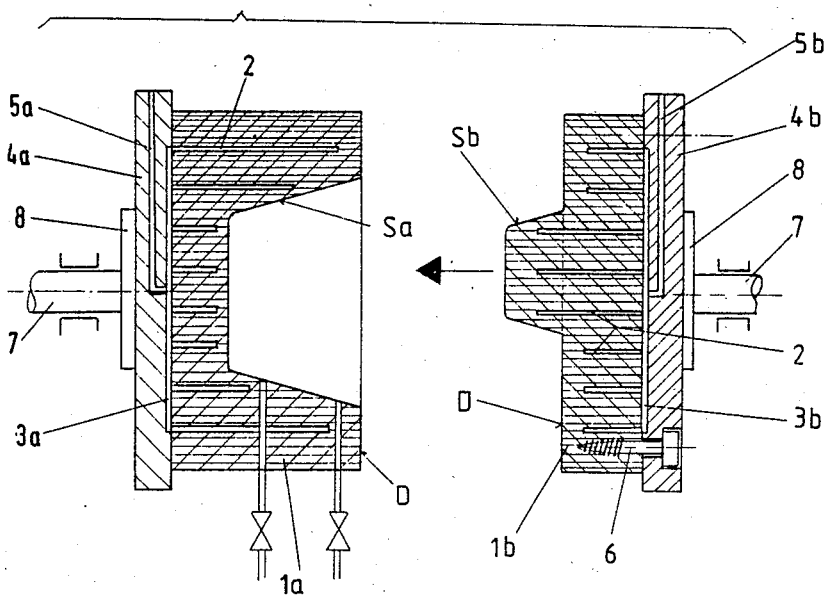

The invention relates to a process for the mass-production conversion of an inorganic and/or organic material, containing a liquid fraction of between 3 and 90% by weight, to a blank by means of core casting and/or hollow casting, the material being introduced into a cavity located between at least two porous mould portions and being dewatered in contact with the adjacent mould portions.

The invention also relates to equipment for carrying out this process.

It is known to those skilled in the art that blanks of liquid or pasty compositions, the moisture content of which can be between 3 and 90% by weight, can be prepared in porous moulds by removing the moisture. A particular field of application of this technique is the mass-production of crockery and sanitary ceramic ware, but the application of the process according to the invention should in no way be restricted to this field. Any possible inorganic and/or organic starting materials which can be made to flow with or without the application of pressure and which can be processed with water or another liquid, are certainly within the scope of use of the invention. The particle size spectrum of the solid base substance can here vary between 0.5μ and 5 mm. In addition to the manufacture of ceramic pieces, preferentially described in the present context, reference may be made, as an example, to the processing of asbestos slip, that is to say an asbestos suspension prepared with the addition of cement.

As is known, the plaster moulds customarily used in the manufacture of crockery and sanitary ceramic ware have the disadvantage that, on the one hand, they can be used for only a limited number of casts, whilst on the other hand the filtration process, that is to say the solidification of the body due to removal of water, is very time-consuming and hence also cost-intensive. At present, it is generally expected that the formation of a body 10 to 11 mm thick requires about 1¼ hours, and that it does not detach itself from the plaster mould, through shrinkage, until a further hour has elapsed. When the customary plaster moulds are used, the next cast cannot therefore be made until after a drying and dehydration step which is expensive in time and energy. Such waiting periods are of course a considerable obstacle to mass-production (Compare Handbuch der Keramik [Ceramics Handbook], Verlag Schmid GmbH, 1970, page 9).

To obviate these disadvantages, attempts have been made for some time to replace the plaster by a more durable material which, in addition to the longer life, should also have a smooth surface and a uniform pore structure in the micro range, if possible. Trials have been made with various porous materials, such as sintered metal and plastics, but it was found in these cases that the problem could not be solved, to a satisfactory extent, by merely replacing the mould material.

For example, one of the problems which has still remained unsolved is the deliberate control of the moisture distribution which necessarily varies within the porous mould during the entire preparation process, in such a way that not only is the water removed from the introduced slip as uniformly and as quickly as possible, but that the mould also retains sufficient water, in the boundary region of the body, for trouble-free detachment of the body, and that this "detaching water" does not remain in the porous mould material at the moment of detachment, but emerges into the abovementioned boundary region and thus forms an ideal release-cushion. It is important in this connection that the said detaching water is present not only in the form of a thin film of moisture, but that a copious water cushion, uniform on all sides, is available.

A particularly important fact is here that such a release-cushion must be free from air occlusions since, if the uniform release-cushion is destroyed by relatively large air occlusions, locally limited adhesion occurs between the body and the mould surface, and this necessarily causes damage to the moist body.

Since the body which has solidified within the mould, in spite of its moisture content which is still high, has a certain tendency to form cracks when the mould is opened or the blank is released, the opening step and/or careful preparations for clean detachment are also of great importance. The experiments hitherto carried out with porous plastic moulds failed due to the complexity of this release problem and the many factors involved.

Particular problems arise in the so-called hollow casting which is virtually unavoidable, for example in the manufacture of sanitary ceramic ware, and also in the case of certain shapes of crockery. In these cases, cavities are formed within the body due to the removal of water, for example when casting a ceramic washbasin, it being particularly difficult to obtain stable walls in these cavities and to avoid running-down of liquid slip adhering to the walls.

Finally, the conventional hollow-casting process also has the further disadvantage that the residual slip or hollow-casting slip, after it has left the mould, must be checked, purified and prepared anew, and this requires additional lines, apparatus and transport means, and hence causes increased costs.

It is thus the object of the present invention to propose a process and equipment for the mass production of blanks, in particular of crockery and sanitary ceramic ware, which process enables the abovementioned disadvantages to be eliminated. Accordingly, the process according to the invention is in particular based on the object of controlling, while using porous plastic moulds, the liquid distribution which fluctuates within the moulds in the course of the preparation process, deliberately and as a function of the particular production phase in such a way that the result is not only a considerable shortening of the filtration step but also optimum release of the body. At the same time, solidification of the moist body is desired, whilst a secondary effect, in a manner of speaking, is that the residual slip or hollow-casting slip can be re-used without any check or purification.

This object is achieved by the combinations of features, defined in the two independent patent claims. Preferred embodiments can be seen from the dependent patent claims.

Figure 6:
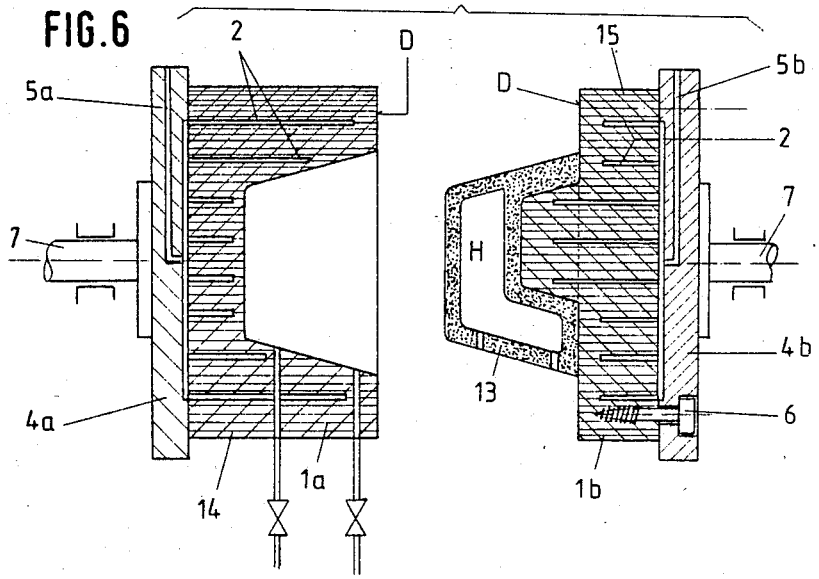
Figure 2:
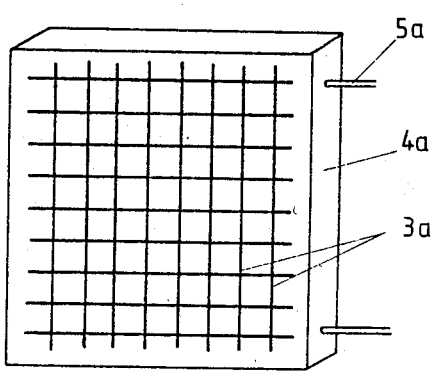
Figure 3:
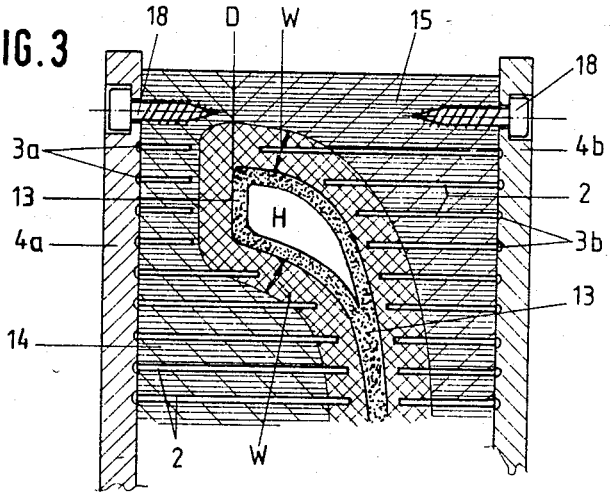
Figure 5:
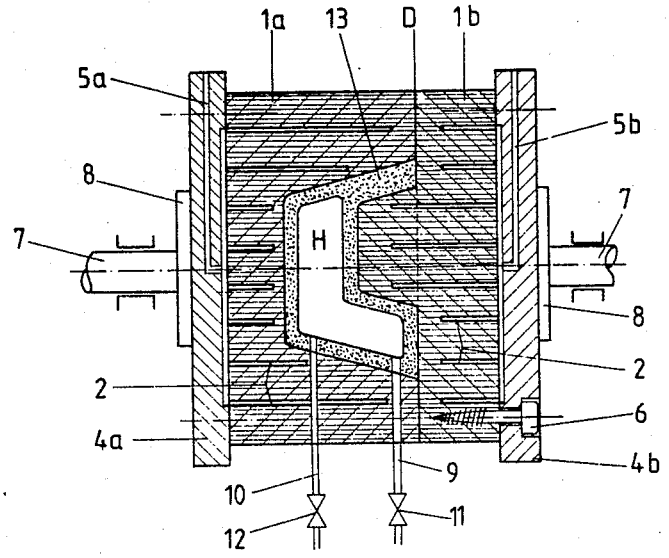
Figure 4:
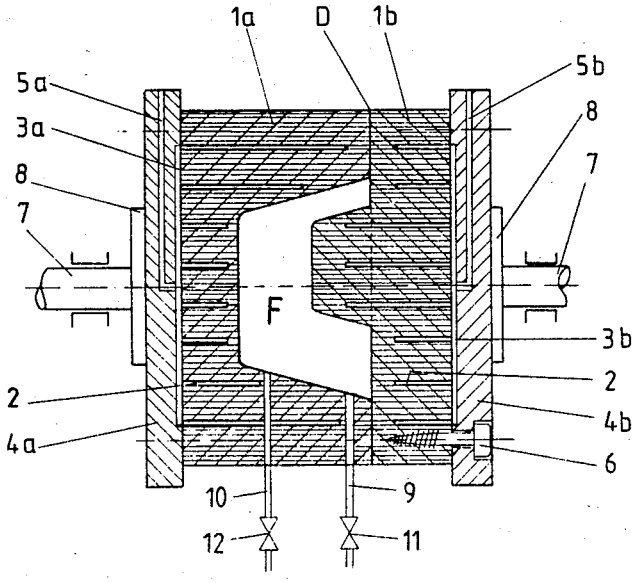
Figure 7:
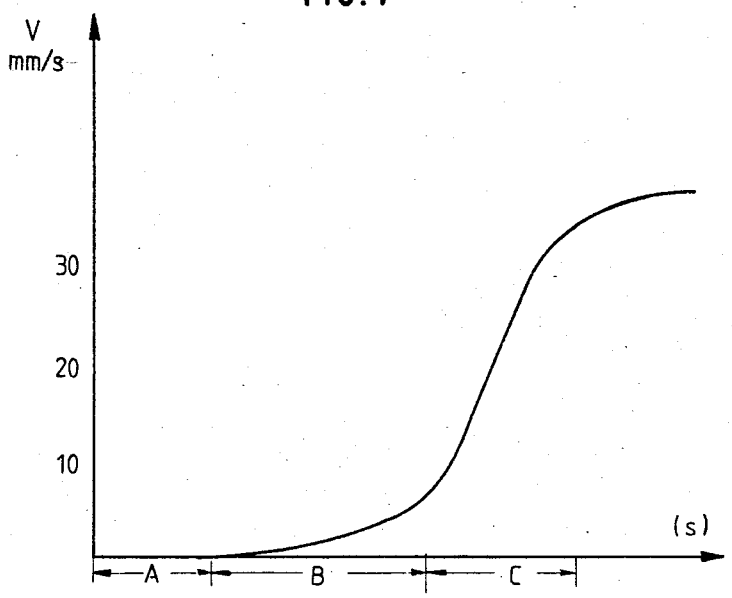

In the following text an illustrative embodiment of the process according to the invention is described by reference to the attached drawing in which:

FIG. 1 shows a simplified sectional representation of equipment for the manufacture of sanitary ceramic ware, for example a ceramic wash basin, FIG. 2 shows a simplified perspective representation of a plate used for holding the mould portions and for feeding and discharging gas and moisture, FIG. 3 shows an enlarged part of a mould, by means of a sectional representation, FIGS. 4 to 6 illustrate various phases of the preparation process by means of sectional representations, and, FIG. 7 shows a diagram which serves to illustrate the relieving or releasing step of blanks, the major part of which consists of a hollow cast.

Figure 9:
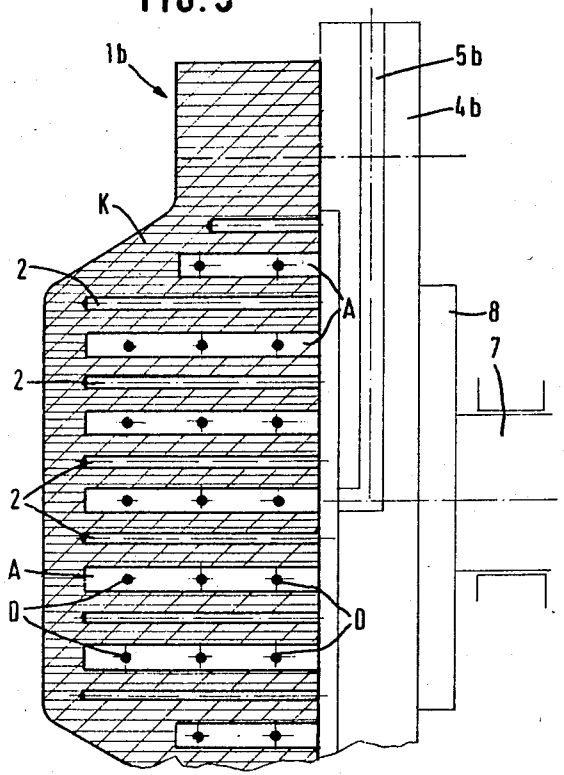
Figure 8:
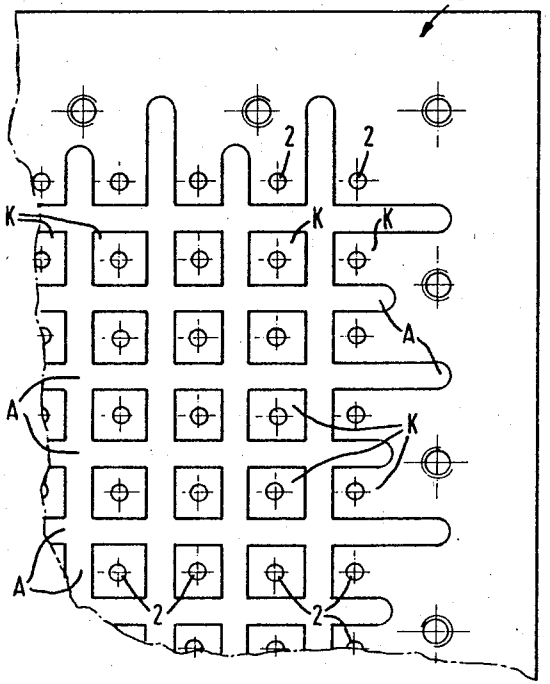

FIGS. 8 and 9 show an illustrative embodiment of a mould portion provided with a reinforcement which takes into account the spcecial structure of the mould positions and other material.

According to FIG. 1, the equipment has two mutually opposite mould portions 1*a* and 1*b* which consist of a porous plastic and, on their mutually facing surfaces, are shaped in such a way that, when they are moved together (compare FIG. 4), they delimit a mould cavity F serving to receive the slip and to form the ceramic body. The two mould portions 1*a*/1*b* are provided with parallel bores 2 which project inwards from the rear end face of each mould portion and end shortly before the front end faces Sa/Sb. These are thus blind bores which can be fed, in each mould portion, by a common network of channels 3*a*, 3*b*. The channels 3*a*/3*b* are machined into the surface of contact pressure plates 4*a*/4*b* which are provided with a feed and discharge channel 5*a*/5*b*.

The contact pressure plates 4*a*/4*b*, preferably made of metal, for example aluminium, have a grid of channels 3*a*/3*b* (compare FIG. 2) on their end faces facing the mould portions and are fixed by means of screws 6 to the mould portions. For the purpose of closing the mould, the two contact pressure plates 4*a*/4*b* can be moved towards one another by means of a drive device which is not shown, for example an appropriate hydraulic energy accumulator, and can be held under pressure for the final sealing of the interface existing between the mould portions. To transmit the force, piston rods 7 are used, for example, which bear against the particular contact pressure plates 4*a*/4*b* by means of end flanges.

At the start of the preparation process, the two-part mould according to FIG. 1 is open. The two mould portions 1*a*/1*b* are connected to a vacuum source via the channel networks 3*a*/3*b*. The vacuum transmitted via the grid system of the contact pressure plate (FIG. 2) to the channels 3*a*/3*b* exerts, due to the porosity of the mould portions, a suction effect which extends virtually as far as the end faces Sa/Sb. This results in careful dewatering, deliberately controlled via the vacuum, of the free surfaces of the mould portion.

As soon as the two mould portions are moved together in the direction of the arrow (FIG. 1) and their sealing surfaces D come to lie on one another, the applied vacuum falls and a vent valve opens which vents the entire channel system of the mould portions. Subsequently, a clamping pressure is applied via the hydraulic pressure-holding system and the piston rods 7, which pressure is above the internal surface pressure of the cast. The mould is then ready to receive the slip.

The slip which forms the prepared starting material for the manufacturing process can consist of an inorganic and/or organic material having a liquid fraction of between 3 and 90% by weight. The particle-size spectrum of the solid base substance can be within wide limits, that is to say between 0.5 $\mu$ and 5 mm.

In the first phase of filling the mould, the casting slip is introduced under a low pressure, that is to say under about 0.1 to 3 bar, in order to avoid turbulence. The slip composition flowing in thus displaces the air volume of the cast, which air escapes through an appropriately fitted orifice (hollow-casting orifice). A small proportion of water, which may be residual water from the preceding preparation step or which may be water separated from the slip newly introduced, can already escape during this initial phase, through the pores of the mould portions and the channel system which is not yet pressurised.

After the hollow mould marked F in FIG. 4 has been filled with slip, a positive pressure of about 10 to 50 bar is applied to the slip, the cast solidifying in the mould, with removal of water. Under the applied positive pressure, the absorption of water by the mould portions is considerably accelerated, so that approximately 50% or more of the water contained in the slip escapes within a few minutes. This water leaving the slip under pressure, the so-called filtration water, is then not forced outwards through the mould portions, but the major part remains in the capillaries of the mould portions directly behind the mould portion surface which faces the cast. Since the filtration water displaces the air contained in the capillaries of the mould portions, and this air can escape unhindered to the outside, an air-free water cushion which is of great importance for the later detachment of the cast forms in the boundary region of the mould portions, adjacent to the cast.

The pressure is applied to the crockery slip present in the mould by hydraulic means, for example with the aid of diaphragms. As FIG. 4 shows, two channels 9 and 10, provided with shut-off valves 11 and 12, lead into the mould cavity F. While the slip is being introduced and subsequently subjected to a vacuum, the filling valve 12 is open and, conversely, the discharge valve 11 is closed. The air contained in the cavity S escapes through the porous mould and the channel system. During this phase of dewatering and solidification under pressure, the channels 3*a*, 3*b*, 5*a* and 5*b* are open.

As long as the casting slip is kept under pressure for the purpose of dewatering and solidification, the channels 3*a*/3*b*/5*a*/5*b* are vented or open. Depending on the composition and viscosity of the slip, and on the material of the porous mould portions, however, it can also be advantageous to apply a pneumatic or hydraulic counter-pressure via the feed channels 5*a*/5*b* during this phase, for the purpose of deliberately controlling the absorption and distribution of moisture within the mould portions. This counter-pressure applied from the outside can, inter alia, have the object of retaining the water which has penetrated from the slip into the mould portions within the latter, so that it is still available during the final release step.

The residual slip or cavity slip remaining after the formation of the body is re-used without additional processing.

The external pressure which holds the two mould portions tightly together during and after the introduction of the slip is released in different phases, a low letting-down and initial opening speed infinitely adjustable within the speed range of 0–10 mm/second being progressively changed to a rapid fast speed, as soon as, as a function of the conicity and depth of the blank, the clearance between the mould portions, necessary for trouble-free opening, has been reached.

According to a further embodiment of the process, however, the formation of the water cushion, which is absolutely necessary for a trouble-free release step and which is not interrupted (for example by relatively large air occlusions), can take place completely independently of any counter-pressure which may be exerted on the channel system of the mould. The absorption and distribution of moisture in the mould are thus not controlled by any type of counter-pressure in this phase, but are exclusively a function of the pressure on the slip side and of the very special properties of the micropore structure and the design of the mould, that is to say the sealing from the outside, the shaping of the sealing surface D and the like.

According to this variant, the water which has penetrated from the slip into the mould thus does not need to be held in the body/mould interface region by a "counter-pressure" applied from the outside; rather, the water cushion remains there, unless it is transported further or altered by errors or wrong measures. Examples of errors or wrong measures in this sense can be:

leaking mould surface in the region D leaking outer mould walls excessive vacuum from the mould side, as compared with the slip pressure, or excessive gas pressure applied for too long a period after hollow-casting, that is to say in the solidification phase of the blank.

In the course of the filtration process, the slip mass then solidifies due to removal of water, and the ceramic body, drawn in FIG. 5 and marked 13, forms on the end faces Sa/Sb of the mould portions. As soon as the formation of the body is complete, that is to say when the body has reached the desired contour and a desired thickness, the valve 11 is opened and the residual slip or cavity slip runs out. This draining process can be assisted by compressed air which can be introduced through the valve 12.

As experience has now shown, there is, on the one hand, a risk of the still wet slip "running down" on the cavity walls, after the residual and cavity slip has been drained off, and hence leading to the formation of streaks; on the other hand, it has been found that the body frequently has insufficient strength, if the duration of action is short. To eliminate these disadvantages, a pneumatic pressure is built up within the cavity H, after the residual or cavity slip has run out, and is maintained for a certain period which depends on the material of the mould portions and the slip material. For example, when a ceramic washbasin was manufactured, a pneumatic pressure of 15 bar was maintained for 10 to 15 seconds. This prevents running down, and some of the water present on the walls of the blank formed penetrates into the blank. The body treated with compressed air in this way has accordingly a dry inner surface and is demonstrably solidified to a greater extent than a ceramic piece which has not been treated with pressure; this can be of decisive importance, in particular in the case of hollow casting.

The step of applying a pneumatic pressure can be repeated several times, it being possible to drain the residual slip material, which has further collected in the meantime, by temporarily opening the drain valve.

Applying a pneumatic pressure to the cavity H thus serves to prevent running down and to achieve a higher strength of the blank. Additionally, the filtrate removed from the slip during the formation of the body penetrates into the boundary layer of the mould portion, adjacent to the body, and forms there the coherent water cushion which is indispensable for the release step. At this stage, it is absolutely necessary to prevent air from penetrating through the body, due to excessively long or intensive application of pressure during the solidification stage of the body, and displacing or interrupting the coherent water cushion (infiltrated air) so that trouble-free release of the body from the mould surface would no longer be ensured.

In fact, as soon as the direct contact between the blank and the water cushion in the mould is interrupted at one point by major air occlusions or a large number of smaller air bubbles, a sufficiently uniform counter-pressure can no longer be built up over the entire body or mould surface by even the most skilful control, and the resulting irregular application of pressure to the piece leads to strains and compressions in the body and hence to defects.

In some cases, the moisture distribution within the mould portions can be additionally controlled by a balanced matching of the air pressure applied in the cavity H and a pneumatic or hydraulic counter-pressure applied from the outside via the channels **5*a*/5*b***.

To release the blank, a vacuum is then applied, according to FIG. 6, initially via the channel **5*b*, to one mould portion 1*b*, while a pneumatic releasing pressure acts via the channel 5*a* on the mould portion 1*a*. As a result, the body 13 is forced out of the mould portion 1*a* and retained by the mould portion 1*b* due to the vacuum. The process thus taking place can best be seen in FIG. 3**.

By means of a simplified sectional representation, FIG. 3 shows two mould portions 14 and 15 which consist of porous plastic and which are in turn clamped between two plates **4*a*/4*b*. The plates are anchored in the mould portions by screws 18. The cavity H surrounded by the two mould portions 14 and 15 serves for the formation of a hollow-cast piece which, in the phase shown, is ready for the release step. Accordingly, some of the filtration water has been displaced by the slip pressure, the capillary action of the porous material and the pneumatic pressure applied to the cavity H, into the adjoining region W of the mould portions. W in FIG. 3 thus marks an uninterrupted water cushion which completely surrounds the body. Of course, this water cushion must not escape to the outside through the channels 2**. This is ensured by holding the water in the body/-mould interface region by preventing the access of air.

This measure is assisted by the capillary forces, acting on the water, of the open pores. To be able deliberately to control the position of the water cushion W in each phase, it is possible, on the one hand, to apply a pneumatic pressure to the cavity H and, on the other hand, to apply a hydraulic or pneumatic counter-pressure from the outside to the mould portions, that is to say, via the channels 2. By mutually matching these pressures, the water cushion can be held in the position shown in FIG. 3, until the release from the mould takes place.

If, as described by reference to FIG. 3 or 6, a positive pressure is applied to the mould portion 14 and a vacuum is applied to the mould portion 15, the stored filtration water W is forced back again towards the cavity H, until it emerges at the interface between the mould portion 14 and the body 13 and hence promotes the release of the body.

Subsequently, the body 13 is detached in a similar manner from the remaining mould portion 1*b* (FIG. 6) or 15 (FIG. 3).

According to FIGS. 4 and 5, the leak-tightness in the sealing gap D between the two mould portions is ensured by the hydraulic pressure which is built up via the piston rods 7 and the press flanges 8. It was then possible to establish by experiments that this contact pressure must not be selected at too high a level.

If it is taken into account that, having regard to the release of the compressible mould portions, the stresses on the body and the slip pressure must be lowered on relieving, the clamping pressure or contact pressure in the boundary region D must not be substantially above the sum of these elastic restoring pressures. If the elastic restoring force of the mould portions is designated FF, that of the ceramic body is designated FK and the slip pressure is designated FS, the following equation describes the clamping pressure FZ:

$$FZ=(FF+FK+FS)\times h$$

where the factor h, which ensures that sealing is maintained in the boundary region D, should be between 1.05 and 1.2.

Moreover, not only the level of the selected contact pressure, but also the timing of the operations involved in opening the mould plays an important role during the relieving step. The feared formation of cracks can be reliably prevented only if the reduction in pressure during the opening step is matched to the particular requirements of the blank, that is to say the pressure reduction takes place slowly in all cases, and the opening step also takes place slowly and in phases in the case of blanks which for the major part consist of a hollow cast, but, in contrast, takes place quickly in the case of blanks which consist for the major part of a core cast.

FIG. 4 and FIG. 7 show the opening speed v, that is to say the speed with which the two sealing surfaces Sa and Sb move apart during the opening step, as a function of the time, for blanks which for the major part have been made by the hollow-casting method. During a first phase marked A, the stresses in the body and the porous mould portions are initially lowered, until the end face of one mould portion begins to be released from the body. This release then takes place extremely slowly (release phase B). After this release phase has been completed, the mould portion can be moved further away from the body relatively quickly (fast opening phase C).

By virtue of a uniform distribution of moisture being possible, the process described is distinguished by a release step which can be perfectly controlled, and by a body which is markedly strengthened as compared with the state of the art. A considerable saving in time results from the fact that, after filling, the slip is briefly kept under pressure. As experience has shown, however, the process of introducing the slip must take place with an initial pressure of only between 0.1 and 3 bar, since otherwise turbulence results. Only afterwards, that is to say after at least a major part of the slip material has been introduced, the pressure can be increased severalfold, for example to 10–50 bar.

It has also been found, and confirmed by trials, that blanks prepared from a warm material (for example a slip at 40° C.) can be released from the mould even more readily and can be further processed sooner and better after release from the mould, because they solidify more rapidly. It is therefore advantageous to preheat the material to 25–50° C. before introducing it into the mould.

The mould portion marked 1*b* in FIG. 1 has, as mentioned, an annular sealing surface D and a projection delimited by the end face Sb (casting face). While the pressure-casting process described is carried out, these two faces D and Sb are stressed on the one hand at different times and on the other hand by different pressures. The mould portion made of porous plastic does not withstand this alternating stress in the long term, as experiments have shown. At the transition from the sealing face D to the casting face Sb, fine cracks soon appear under the influence of the notch effects which occur, and these cracks result in fracture of the mould portion when use of the latter is continued.

The same also applies in a similar manner to the mould portion 1*a*.

In order to impart the strength, required in operation, to the mould portions 1*a* and 1*b*, these are preferably provided with a reinforcement which takes into account the special structure of the mould portions and their material. An illustrative embodiment of a mould portion reinforced in this way is described below by reference to FIGS. 8 and 9.

In the mould portion here also marked 1*b*, those reference numerals which have remained unchanged from FIG. 1 have been retained.

To show the reinforced construction clearly, the porous plastic mass, the main function of which is the absorption of water, is marked K in FIGS. 8 and 9. This plastic mass K is penetrated by a coherent reinforcing grid A which, in the region of the bores 2, is in each case taken around these at a distance and also extends down to a depth which corresponds to that of the bores 2. The grid structure of the reinforcing grid A thus surrounds all the bores 2 over the total length thereof (FIG. 9) and provides the mould portion with considerable resistance to the pressure stresses which occur. In the illustrative embodiment shown, the reinforcing material A fully penetrates the interspaces between the individual bores 2 and thus forms a network of intersecting stiffening walls.

According to a preferred embodiment, the reinforcing grid A consists of the same plastic which forms the water-absorbing mass K, but with the difference that pore-forming substances have not been added to this plastic during its manufacture. This ensures that the base mass K and the reinforcement A perfectly bond with one another, whilst, on the other hand, a considerable increase in strength results due to the elimination of the pores.

However, other reinforcing materials can also be used in place of this preferred material.

It can also been seen from FIG. 9 that the structure of the reinforcing grid A in the vaiant shown is penetrated by metallic wire grids G, the three wire grids P here being arranged one above the other at a mutual distance. In their pitch, the grids P exactly correspond to the arrangement of the reinforcing grid A shown in FIG. 8.

There are various possibilities for fitting the reinforcing grid A. According to a preferred variant, recesses are drilled or milled in the finished cast mould portion 1*a* or 1*b* (as in FIG. 1), and the reinforcing material is then cast into these recesses, after the bores 2 have been closed means of stoppers. It is, however, also possible in principle to leave the recesses, required for the reinforcement, free even during the first casting, and then to fill them with the second casting.

I claim:

1. A method for the production of blanks by processing slip, consisting of an inorganic and/or organic material having a liquid fraction of between 3 and 90% by weight, by means of core casting and/or hollow casting, comprising the steps of (a) introducing slip into a mould cavity of a mould, the mould including at least two mould portions formed of porous plastic material and having a plurality of blind holes distributed in a pattern over each mould portion, being adjoined at the side opposite to the mould cavity by a system of channels connected to the open ends of the blind holes, introducing of slip via an inlet channel into the mould cavity under an initial pressure of between 0.1 and 3 bar, and by simultaneously displacing air and residual liquid if present, from the mould cavity into the porous material of the mould portions (b) applying increased pressure of between 10 to 50 bar onto the slip contained in the mould cavity by simultaneously displacing liquid from the slip into the porous material of the mould portions and into blind holes as well as the system of channels, respectively, and (c) maintaining that increased pressure until the slip is solidificated at least up to a certain degree.

2. A method according to claim 1 wherein during an initial phase of the application of increased pressure the liquid which is displaced into the porous material of the mould portions is drained via the blind holes and the system of channels and thereafter a counter pressure is applied to the mould portions via the channels and blind holes, in order to temporarily accumulate part of the liquid at least in the boundary layer of the mould portions adjacent to the mould cavity surfaces.

3. The method according to claim 2 for manufacturing a hollow casting blank or a combined hollow and core casting blank wherein after a certain solidification of the slip at the mould cavity surfaces, liquid-containing residual material from the inner walls of the blank cavity is blown out and thereafter a gas pressure is built up in this blank cavity.

4. A method according to claim 3 wherein the build-up of gas pressure within said blank cavity is repeated several times.

5. A method according to claim 4 wherein the liquid present in the mould cavity boundary layer is held in this layer on the mould cavity side by balanced interaction of this gas pressure with gas or liquid pressure acting via the system of channels and via the blind holes on both mould portions.

6. A method according to claim 4 wherein the liquid present in the mould cavity boundary layer is held in this layer on the mould cavity side by balanced interaction of this gas pressure with gas or liquid pressure acting via the system of channels and via the blind holes on both mould portions.

7. A method according to claim 5 wherein the residual slip or blank cavity slip remaining after the formation of the blank is re-used without additional processing.

8. A method according to claim 3 wherein for building up said gas pressure, compressed air is used which is introduced into the said blank cavity through the inlet channel in the mould portions.

9. A method according to claim 4 wherein for building up the said gas pressure, compressed air is used which is introduced into the said blank cavity through the inlet channel in the mould portions.

10. A method according to claim 1, wherein external pressure means which hold the two mould portions tightly together during and after the introduction of the slip is released in different phases, insofar as a low letting-down and initial opening speed infinitely adjustable within the speed range of 0–10 mm/second being progressively change to a rapid fast speed, as soon as, as a function of the conicity and depth of the blank, the clearance between the mould portions, necessary for trouble-free opening, has been reached.

* * * * *